US005888181A

United States Patent [19]

Yeh

[11] Patent Number: 5,888,181

[45] Date of Patent: Mar. 30, 1999

[54] AUXILIARY SPORTING DEVICE

[76] Inventor: Hsiu Ying Yeh, 2F., No.4-1, Alley7, Lane 133, Chu Kwang Rd., Pan Chiao, Taipei, Taiwan

[21] Appl. No.: 7,181

[22] Filed: Jan. 14, 1998

[51] Int. Cl.[6] ..... A63B 23/02

[52] U.S. Cl. ..... 482/140; 402/131; 402/139; 402/142

[58] Field of Search ..... 482/10, 92, 95, 482/94, 93, 131, 132, 139, 140, 142, 146, 148, 907, 908; 606/240; 128/845, 869, 870; D21/686–691, 694, 695; D24/190, 191; 16/252, 254, 260, 268, 270, 388, 390, DIG. 70; D29/102

[56] References Cited

U.S. PATENT DOCUMENTS

| | | | |
|---|---|---|---|
| D. 350,171 | 8/1994 | Kunewalder et al. | D21/690 |
| D. 383,510 | 9/1997 | Bernardson | D21/688 |
| 695,538 | 3/1902 | Clairmont | 482/145 |
| 4,598,889 | 7/1986 | Remington | 16/260 |
| 4,752,067 | 6/1988 | Colonello | 482/142 |
| 4,951,939 | 8/1990 | Peters | 482/94 |
| 5,060,937 | 10/1991 | Rushatz et al. | 482/142 |
| 5,076,579 | 12/1991 | Rickey | 482/142 |
| 5,147,267 | 9/1992 | Kunewalder | 482/142 |
| 5,346,447 | 9/1994 | Stearns | 482/93 |

FOREIGN PATENT DOCUMENTS

| | | | |
|---|---|---|---|
| 3326078 | 1/1985 | Germany | 482/140 |

*Primary Examiner*—Jeanne M. Clark
*Attorney, Agent, or Firm*—Jacobson, Price, Holman & Stern, PLLC

[57] ABSTRACT

An auxiliary supporting device generally comprises a head pad section, a backrest, section, a hip section and a joint set. The insert of the head pad section can be inserted into the receiving hole of the backrest section such that the projected section of the head pad section is biased against to the front section of the backrest section. The moveable latch of the backrest section can be inserted into the moveable latch hole of the rolling rod. And then a pair of positioning latches can be inserted into the positioning latch holes such that the relative position between the supporting arm of the bottom bracket and the rolling rod can be attained. The clamp of the retaining block of the hip pad section can be engaged with the retaining beam of the backrest section. By this arrangement, a foldable auxiliary sporting device is attained.

3 Claims, 8 Drawing Sheets

AUXILIARY SPORTING DEVICE

FIELD OF THE INVENTION

The present invention relates to a sporting device, more particularly, to an auxiliary sporting device in which the sporting device can be readily disassembled and folded:

DESCRIPTION OF PRIOR ART

The conventional auxiliary sporting device is made from injected molding and it can not be disassembled or folded when it is not in use. On the other hand, the auxiliary sporting device is used to shimming the user's shoulder and/or head and it does have a planar configuration that is parallel to the ground. Accordingly, if the auxiliary sporting device can not be disassembled and/or folded, it may occupy a great deal of space when it is not in use.

SUMMARY OF THE INVENTION

It is the objective of this invention to provide an auxiliary sporting device that can be readily disassembled and folded when not in use. Accordingly, the inconvenience and problems encountered by the existing auxiliary sporting device can be therefore solved.

According to one aspect of the present invention, the auxiliary sporting device can be readily disassembled and/or folded while the overall rigidity will not be compromised.

According to another aspect of the present invention, the working direction of the auxiliary sporting device is increased such that the sporting load of the user within the same interval can be increased. The sporting perfomance can be increased also.

In order to achieve the objective set forth, the auxiliary supporting device generally comprises a head pad section, a backrest section, a hip section and a joint set. The head pad section includes a soft pad to sustain the weight of the head of user. The head pad section includes a flexible supporting plate that includes a projected section and an insert. When the insert is inserted into the receiving hole of the backrest section, the projected section is biased against to the front section of the backrest section. The insert is pressed by the backrest section and the torque applied to the projected section, that is generated by the weight of the head of user, can be suitably balanced. The flexible supporting plate may partially absorb the weight of the head of user. The hip pad section is connected to the retaining beam of the retaining groove by a clamp of a retaining block. The hip pad section is supported by the floor through a pad, Accordingly, the weight of the user can be readily supported. The joint set includes a pair of supporting arms that have a pair of curve supporting slots to support the rolling rod thereof. The relative position between the rolling rod and the bottom bracket can be readily facilitated by the positioning latch that is received within the positioning hole. The positioning latch can be inserted through the inner and/or outer side of the bottom bracket. By this arrangement, the rolling rod will not escape from the curve rolling slot. On the other hand, when the moveable latch is inserted to the moveable latch hole of the rolling rod the backrest pad can be swiveled in all directions to increase the working load of user.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
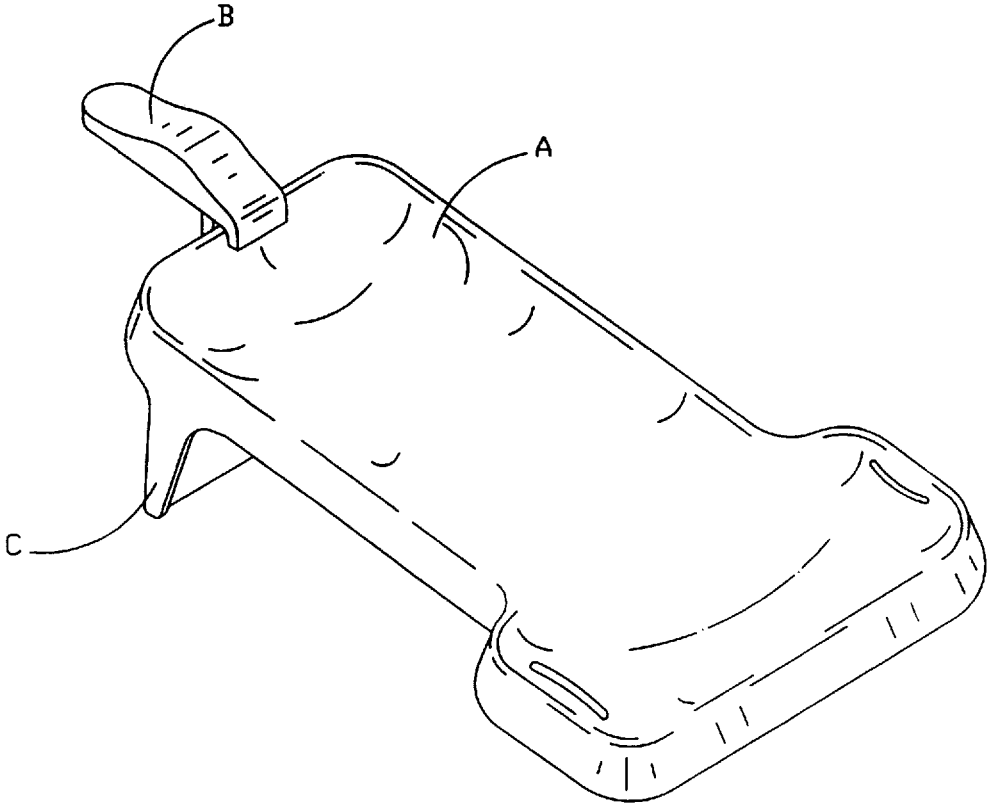
FIG. 1 is a perspective view of the conventional auxiliary sporting device.

As shown in FIG. 1, the body (A) of the conventional auxiliary sporting device uses legs (C) to shim up the shoulder and/or head. The overall configuration is not parallel to the floor or ground. Accordingly, a great deal of space is wasted. Even in some auxiliary sporting device, the head pad (B) is removably attached to the body, the storing problem is still suspended without being completely solved. On the other hand, the sustaining capability of the head pad (B) is also quite weak.

Figure 2:
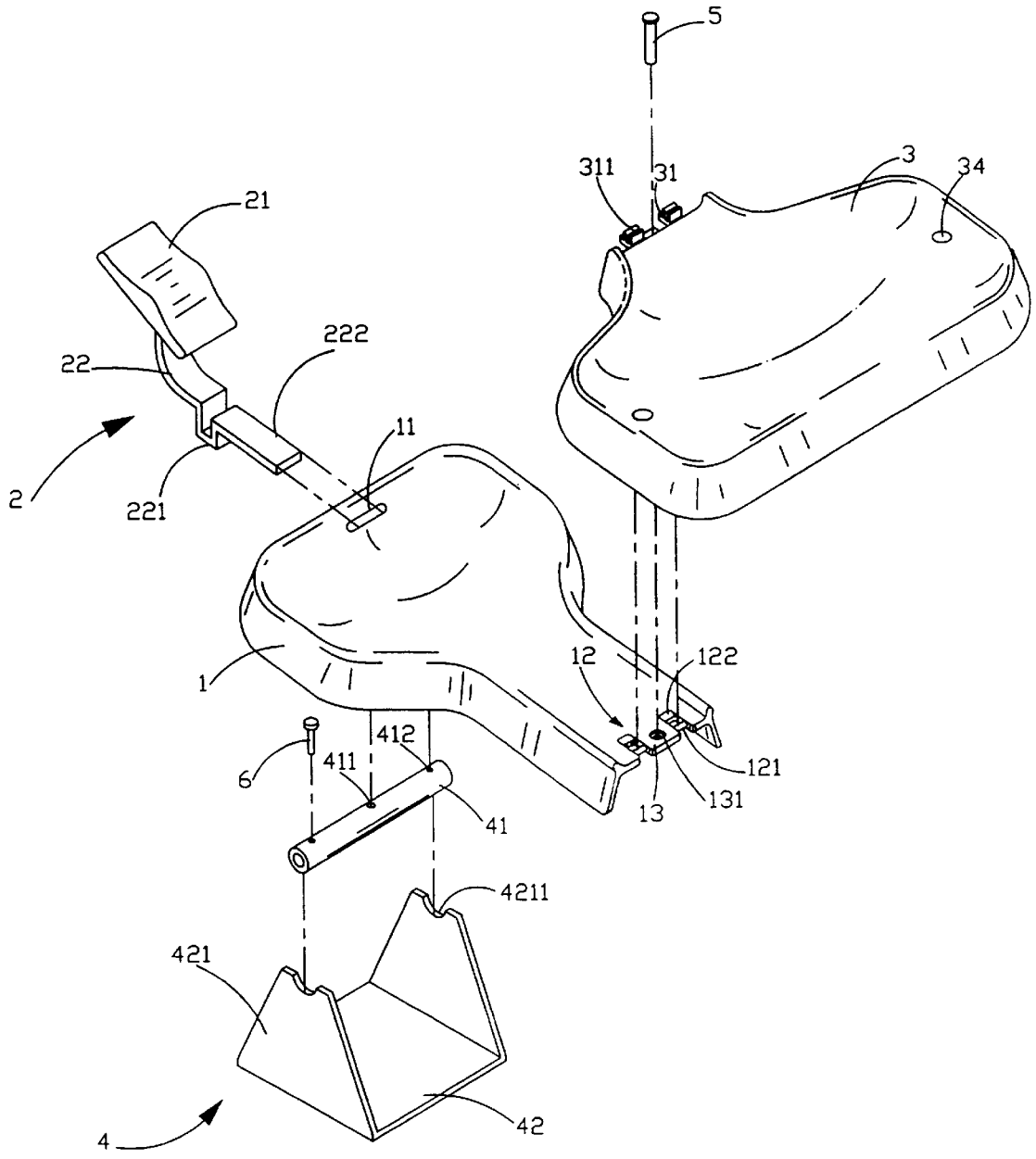
FIG. 2 is an exploded view of the auxiliary sporting device made according to the present invention.
Figure 3:
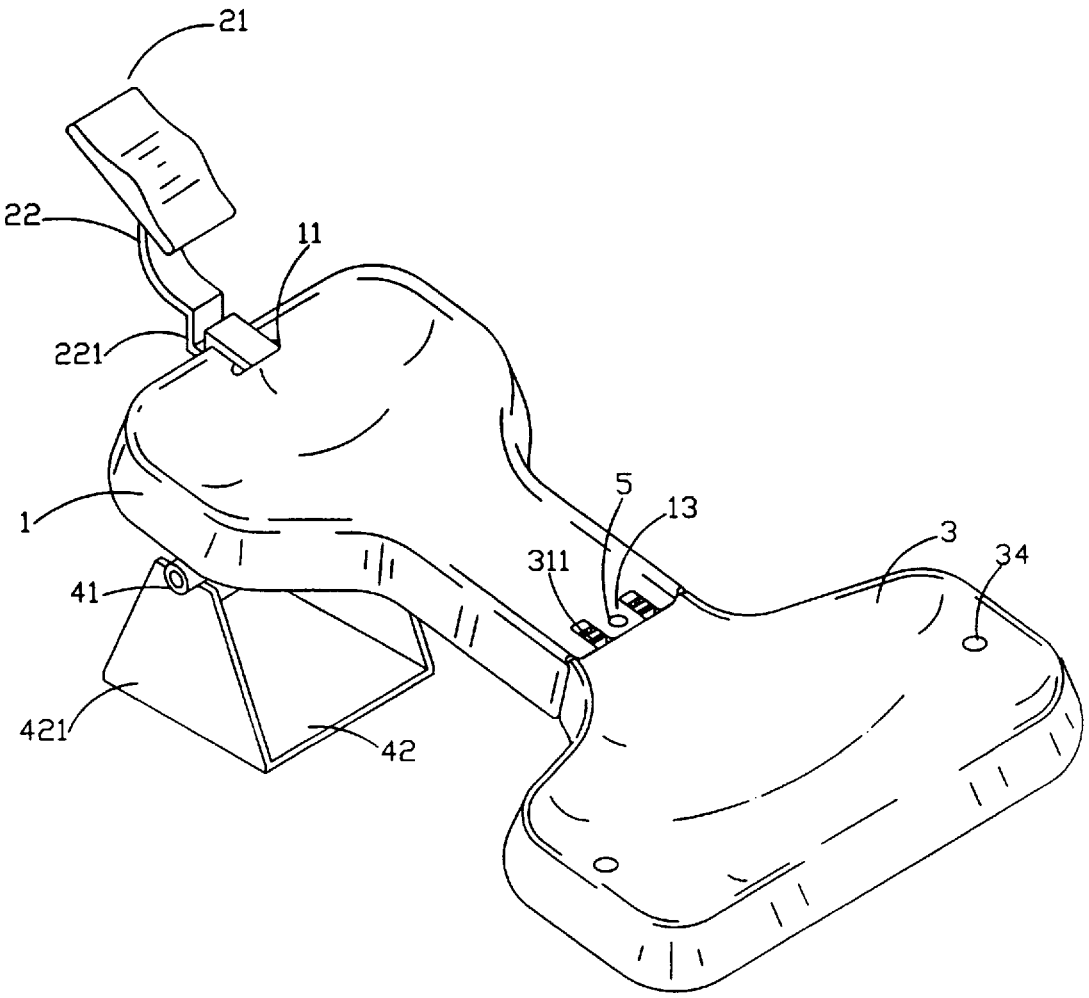
FIG. 3 is a perspective view of the auxiliary sporting device made according to the present invention.
Figure 4:
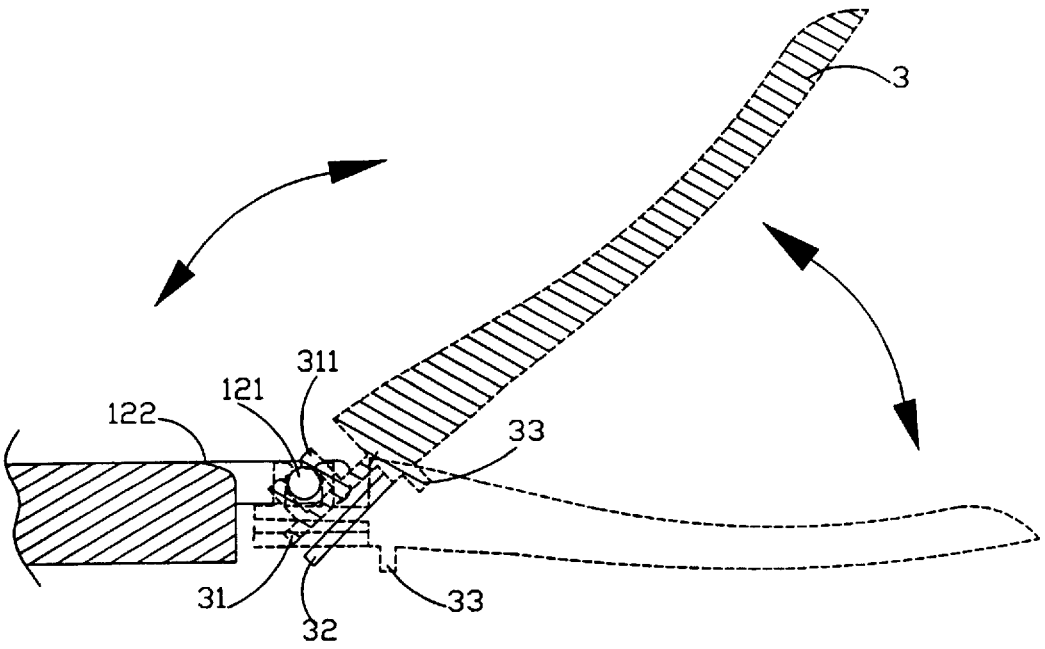
FIG. 4 is a schematic illustration showing a first bending movement between the backrest and hip pad.
Figure 5:
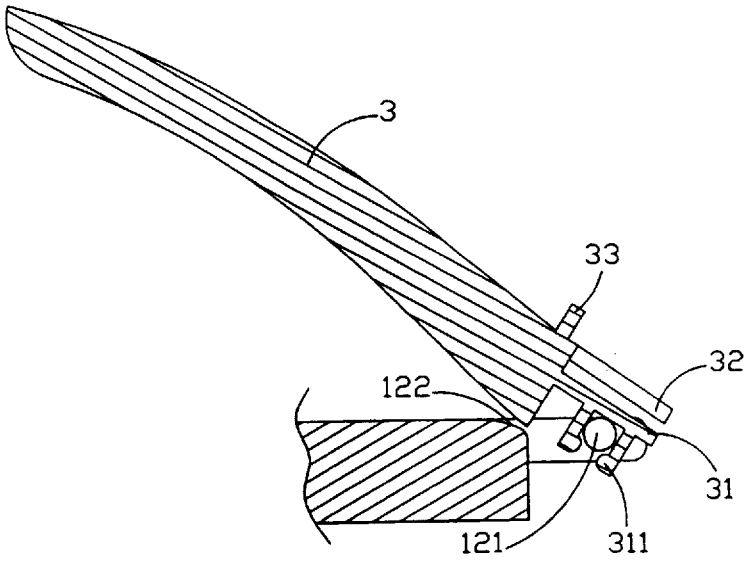
FIG. 5 is a schematic illustration showing a second bending movement between the backrest and hip pad.

Referring to FIGS. 2., 3 and 4, the auxiliary sporting device generally comprises a head pad section 2, a backrest section 1, a hip pad section 3, and a joint set 4.

The head pad section 2 is configured by a supporting plate 22 having a projected section 221 thereof and that is biased against to the front edge of the backrest section 1. The supporting plate 22 further includes an insert 222 that can be received within a receiving hole II of the backrest section 1. The head pad section 2 further includes a soft pad 21 in the top surface and that is used to support the head of the user.

The tail section of the backrest section 1 is provided with a retaining groove 12 and an upper positioning tab 13. A retaining bean 121 is disposed within the retaining groove 12. The upper positioning tab 13 is provided with an upper latch hole 131. The back section of the backrest section 1 is provided with a moveable latch 132. The retaining groove 12 further includes an inclined surface 122 such that the hip pad section 3 can be smoothly rested thereof.

The front section of the hip pad section 3 is provided with a lower positioning tab 32 and a retaining block 31 that are adjacent to the backrest pad I and corresponding to the retaining groove 12 and the upper retaining tab 13 respectively. The retaining block 31 includes a clanip 311 that can be releasably engaged with the retaining beam 121 of the retaining groove 12. The lower positioning tab 32 is also provided with a lower latch hole 321 that are aligned with the upper latch hole 131 of the upper positioning tab 13. A locking latch 5 can be inserted into the tipper and lower latch holes 131, 321 respectively. The bottom surface of the hip pad section 3 is provided with a pad 33 that is used to sustain the weight of the user.

The joint set 4 includes a rolling rod 41 that is provided with a plurality of dowel holes 411 in which the moveable latch 132 of the backrest pad 1 can be readily inserted therein. Tile rolling rod 41 further includes a plurality of positioning hole 412 in which the positioning latch 6 can be inserted therein. The joint set 4 further includes a bottom bracket 42 that includes a pair of supporting arms 421 thereof. The upper section of the supporting arm 421 is provided with a curve rolling slot 4211. Wherein when a pair of positioning latches 6 are inserted into the positioning holes 412, a relative position between the inner or outer side section of the bottom bracket 42 and the rolling rod 41 can be attained.

Figure 6:
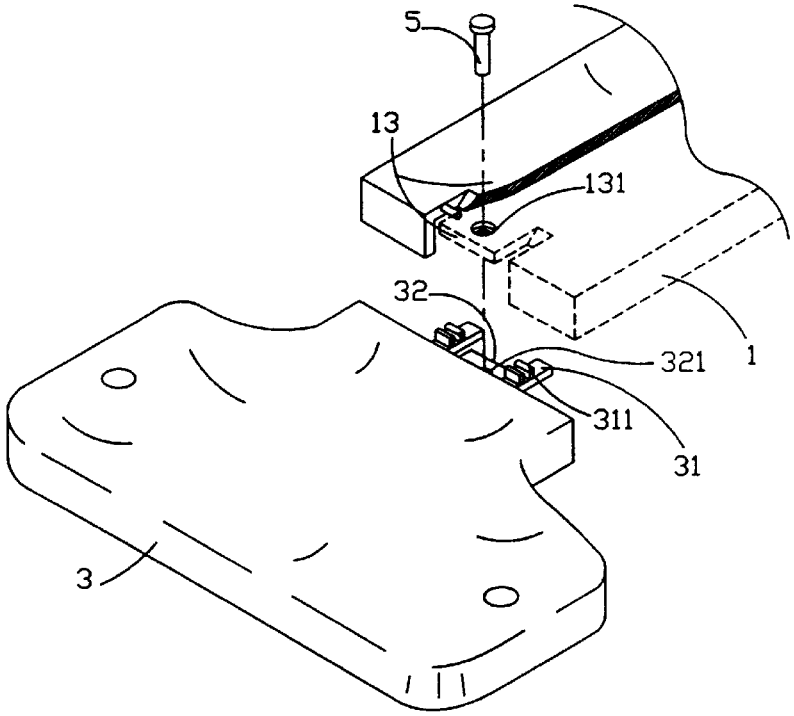
FIG. 6 (PRIOR ART)
FIG. 6 is a schematic illustration showing the connection between the backrest and the hip pad of the auxiliary sporting device shown in FIG. 2.

Referring to FIG. 6, the engagement between the hip pad section 3 and the backrest 1 is firstly facilitated by the clamp 3 11 of the retaining block 31 and the retaining beam 121 of the retaining groove 12. Then the positioning latch 5 is inserted into the upper and lower latch holes 131, 132 of the tipper positioning tab 13 and the lower positioning tab 32 respectively. By this arrangement, when the positioning latch 5 is lifted up, the hip pad 3 can be rotated and rested onto the backrest section 1.

Figure 7:
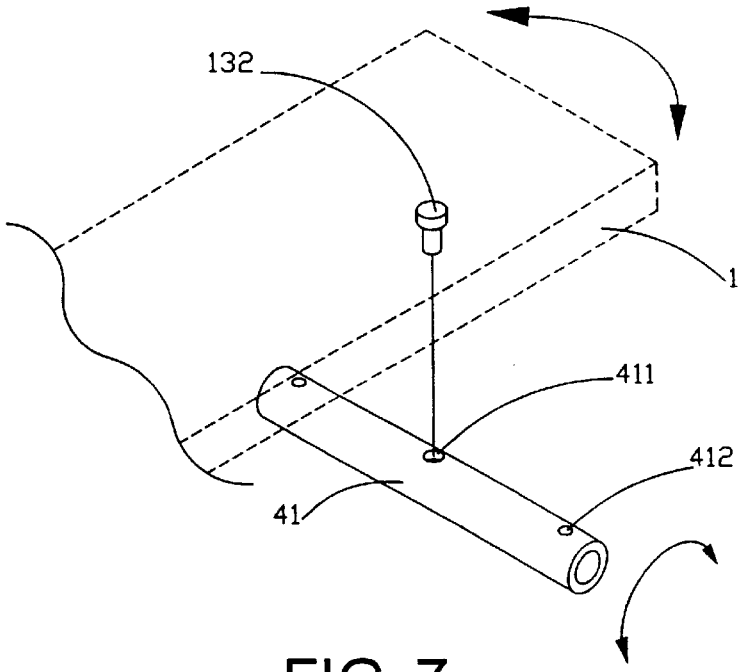
FIG. 7 is an axial view of the pivotal shaft of the backrest of the auxiliary sporting device.

Referring to FIG. 7, the connection between the backrest section 1 and the rolling rod 41 is facilitated by the moveable latch 132 that is pivotally attached to the moveable latch hole 411 of the rolling rod 41. By this arrangement, the backrest 1 can be pivotally moved with respect to the moveable latch 132. On the other hand as the rolling rod 41 has a round configuration and is well supported by the circular rolling slots 4211 of the supporting arms 421 of the bottom bracket 42. In light of this, the backrest section 1 can be readily swiveled in all directions.

Figure 8:
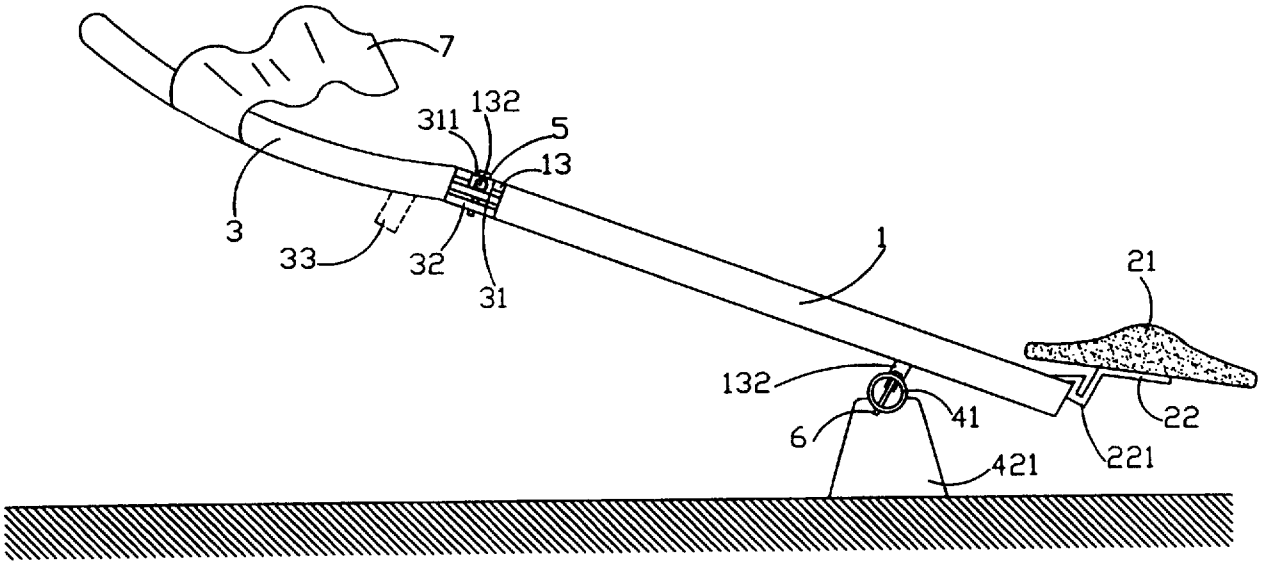
FIG. 8 is a side view of the auxiliary sporting device.
Figure 9:
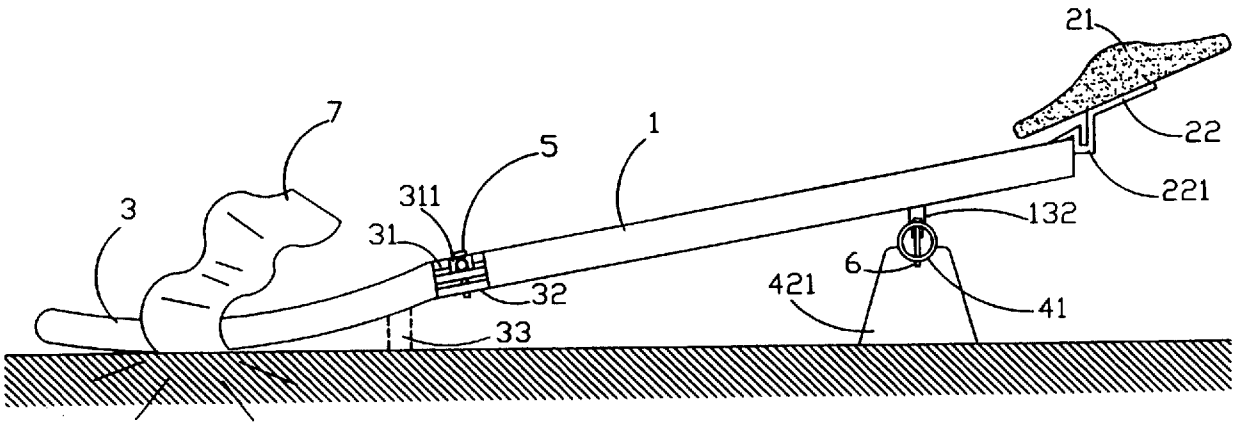
FIG. 9 is a side view showing the up-and-down rotation of the auxiliary spotting device.

Referring to FIGS. 8 and 9, if the hip pad section 3 is not equipped with a soft pad 33 in the back section, the hip pad section 3 can still be used when it is lifted upward. Nevertheless, once the hip pad section 3 is lowered down, the hip pad section 3 could be damaged resulted from adverse impact.

Figure 10:
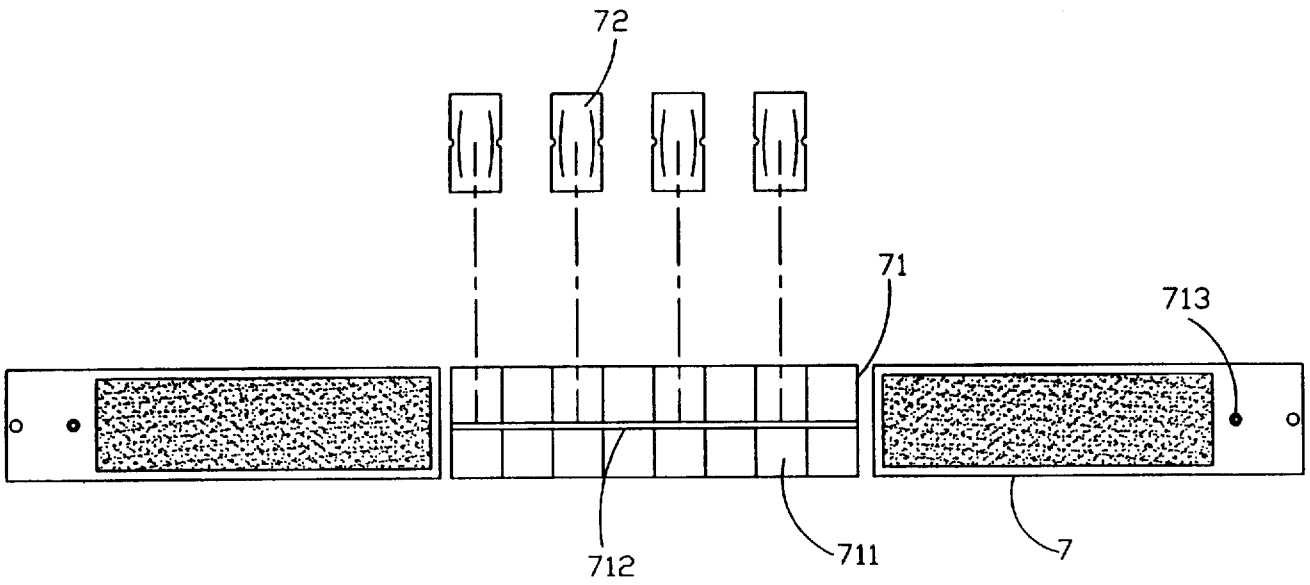
FIG. 10 is a schematic illustration showing application of the waistband.

Referring to FIG. 10, the hip pad section 3 can be provided with a pair of waistband mounting holes 34 in which the fastener 712 of the waistband 7 can be readily retained therein. The waistband 7 is further provided with a Velcro or hook and loop fastener strap 71 that can fasten the side waistband 7 thereof. If the user hope to strengthen the muscles in abdomen, the weights 72 can be disposed within the pocket 711. Then the pocket can be fixedly positioned by suitable fastening strip.

While particular embodiment of the present invention has been illustrated and described it would be obvious to those skilled in the art that various other changes and modifications can be made without departing from the spirit and scope of the invention. It is therefore intended to cover in the appended claims all such changes and modifications that are within the scope of the present invention.

I claim:

1. An auxiliary sporting device of the types that comprises a head pad section, a backrest section, a hip pad section, and a joint set, wherein said head pad section includes a supporting plate having a projected section and an insert thereof;

said backrest section being provided with a receiving hole, that is adjacent to said head pad section, for receiving said insert therein, a tail section of said backrest section being provided with a retaining groove and an upper positioning tab, a retaining beam being disposed within said retaining groove, said upper positioning tab being provided with an upper latch hole and the a section of said backrest section being provided with a moveable latch;

said hip section being provided with a lower positioning tab and a retaining block, that are adjacent to said backrest section and corresponding to said retaining groove and said upper retaining tab, respectively in a front section, said retaining block including a clamp that can be releasably engaged with said retaining beam of said retaining groove, said lower positioning tab being also provided with a lower latch hole that is aligned with said upper latch hole of said tupper positioning tab such that a locking latch can be inserted into said upper and lower latch holes, a bottom surface of said hip pad section being provided with a pad;

said joint set including a rolling rod that is provided with a plurality of dowel holes in which said moveable latch of said backrest section can be readily inserted therein, said rolling rod further including the positioning hole in which the positioning latch can be inserted therein, said joint set including a bottom bracket that includes a pair of supporting arms thereof, an upper section of each of said supporting arm being provided with a curve rolling slot thereof;

wherein said insert of said supporting plate of said head pad section can be firstly inserted into said receiving hole of said backrest section such that said projected section of said supporting plate is biased against to a front section of said backrest section, said moveable latch of said backrest section being inserted into one of said dowel holes of said rolling rod and a pair of positioning latches are inserted into said positioning holes, then a relative position between an inner or outer side section of said bottom bracket and said rolling rod can be attained, said retaining beam of said retaining groove can be fastened by said clamp of said retaining block of said hip pad section, consequently, a foldable auxiliary sporting device is attained, characterized in that said head pad section is moveably inserted into said receiving hole of said backrest section via said supporting plate that has a projected section thereof, said hip pad section being attached to said backrest section byimeanis of said clamp of said retaining block that is fastened to said retaining beam of said retaining groove, a locking latch is passed through said upper and lower positioning tabs, said moveable latch of said backrest section is inserted into one of said dowel holes of said rolling rod and said pair positioning latches are inserted into said positioning latch holes.

2. An improved auxiliary sporting device as recited in claim 1, wherein said hip pad section is provided with a waistband mounting hole for positioning a hook and loop fastener strap thereof.

3. An improved auxiliary sporting device as recited in claim 2, wherein said hook and loop fastener strap is provided with pocket for containing weights therein.

* * * * *